US008046919B2

(12) United States Patent
Coughlin et al.

(10) Patent No.: US 8,046,919 B2
(45) Date of Patent: Nov. 1, 2011

(54) METHOD OF MANUFACTURING A SHUTTER

(75) Inventors: Timothy J. Coughlin, Holly, MI (US); Donald Verna, Wixom, MI (US); Richard C. Kruyer, Schwartz Creek, MI (US)

(73) Assignee: Pinckney Molded Plastics, Inc., Howell, MI (US)

( * ) Notice: Subject to any disclaimer, the term of this patent is extended or adjusted under 35 U.S.C. 154(b) by 1301 days.

(21) Appl. No.: 11/672,980

(22) Filed: Feb. 9, 2007

(65) Prior Publication Data

US 2007/0193173 A1 Aug. 23, 2007

Related U.S. Application Data

(60) Provisional application No. 60/771,632, filed on Feb. 9, 2006.

(51) Int. Cl.
*B21D 47/00* (2006.01)
*E06B 3/70* (2006.01)
*E06B 7/08* (2006.01)

(52) U.S. Cl. ..... 29/897.32; 29/897.3; 29/401.1; 29/416; 29/417; 52/456; 52/473; 52/784.1; 52/745.16

(58) Field of Classification Search ..... 29/897, 29/897.3, 897.31, 897.312, 897.33, 401.1, 29/411, 412, 414, 415, 416, 417, 464, 897.32; 52/313, 473, 455–458, 784.1, 745.16
See application file for complete search history.

(56) References Cited

U.S. PATENT DOCUMENTS

| | | | | | |
|---|---|---|---|---|---|
| 1,044,047 | A | * | 11/1912 | Hess | 52/630 |
| 18,077 | A | | 5/1931 | Larson | |
| 3,191,242 | A | | 6/1965 | Rauen | |
| 3,394,518 | A | | 7/1968 | Worrell | |
| 3,455,079 | A | | 7/1969 | Frederick | |
| 3,527,486 | A | | 9/1970 | Gamp | |
| 3,548,555 | A | | 12/1970 | Trostle et al. | |
| 3,797,186 | A | | 3/1974 | Smith | |
| 3,932,959 | A | | 1/1976 | Jansons et al. | |
| 3,968,738 | A | | 7/1976 | Matzke | |
| 4,251,966 | A | | 2/1981 | Foltman | |
| 4,765,110 | A | | 8/1988 | MacLeod | |
| 4,858,400 | A | | 8/1989 | Foyt | |
| 5,060,442 | A | | 10/1991 | Chubb | |
| 5,152,116 | A | | 10/1992 | MacGowan | |
| 5,256,354 | A | * | 10/1993 | Chadwick | 264/119 |
| 5,295,726 | A | * | 3/1994 | Carter et al. | 296/191 |
| 5,347,782 | A | | 9/1994 | Vagedes | |
| 5,430,986 | A | | 7/1995 | Vagedes | |
| 5,482,323 | A | * | 1/1996 | Hicks | 280/785 |
| 5,622,018 | A | | 4/1997 | Schiedegger | |
| 5,634,998 | A | | 6/1997 | Schiedegger et al. | |
| 5,704,182 | A | | 1/1998 | Schiedegger et al. | |
| 5,761,865 | A | | 6/1998 | Schiedegger et al. | |
| 5,782,052 | A | | 7/1998 | Lacy | |
| 5,946,873 | A | | 9/1999 | Schiedegger et al. | |
| 6,023,905 | A | | 2/2000 | Schiedegger | |
| 6,122,875 | A | | 9/2000 | Schiedegger et al. | |

(Continued)

*Primary Examiner* — Sarang Afzali
(74) *Attorney, Agent, or Firm* — Young Basile

(57) ABSTRACT

A method of manufacturing a plastic molded shutter assembly that can be customized in size. A shutter of a standard length, or series of shutters of standard lengths are manufactured. A plurality of cuts are made in the shutter, removing a predetermined amount of material from the shutter. The end cap is replaced and fixedly secured to the remaining shutter, resulting in a single shutter of a desired length.

14 Claims, 4 Drawing Sheets

U.S. PATENT DOCUMENTS 6,141,938 A 11/2000 Schiedegger
6,397,540 B1 6/2002 Schiedegger
6,670,012 B2 * 12/2003 Campbell et al. ..... 428/60
2005/0284023 A1 12/2005 O'Hair

* cited by examiner

METHOD OF MANUFACTURING A SHUTTER

CROSS REFERENCE TO ELATED APPLICATION

This application claims the benefit of U.S. Provisional application No. 60/771,632 filed Feb. 9, 2006.

FIELD OF THE INVENTION

The invention relates generally to the manufacture of shutter panels and more particularly to shutter panels that can be customized in length.

BACKGROUND OF THE INVENTION

Different plastic injection molded shutters exist in the market, including customizable shutters. Customizable shutters are desirable because the costs associated with injection molds for each shutter length are high. The methods used for the customizable shutters require at least two injection molded components and a multiplicity of complex cuts to remove the excess material. In particular, the methods require the injection molding of a standard shutter and the injection molding of the shutter ends, which are removed from the original shutter when the excess material is removed. The removal of the excess material involves a series of cuts, including angled and straight lines, along the seams formed in the shutter designs. These assemblies can be higher in cost due to the multiple injection molded components, the complex cutting pattern, and the extra material waste. And because the assembly processes include multiple injection molded components, the components can be slightly dissimilar in coloration. It would be desirable to provide a method of customizing a shutter having a single injection molded component and less material waste. Therefore it is an objective of the present invention to provide a method of reducing the length of a standard shutter using a single injection molded shutter.

SUMMARY OF THE INVENTION

In accordance with the present invention, a preferred embodiment of a closure panel, for example a shutter panel assembly, includes molding a single plastic shutter panel of a standard size. Alternatively, the single molded plastic shutter panel is selected from a few pre-molded plastic shutter panels of common panel lengths. The shutter panel selected is the common panel length that is greater than the desired length and is closest to the desired panel length. The plastic molded shutter panel can be, for example, configured with a decorative pattern having two symmetrical center panel portions. The measurement of unwanted excess length of the shutter is determined. A cut is made straight across one end of the shutter at the upper horizontal edge of the raised top center panel section, completely detaching a first small portion from the remaining shutter. The small detached portion forms a top end cap of the shutter. A second cut is made across the opposing end of the shutter at the lower horizontal edge of the raised center panel section, completely detaching a second small portion from the remaining shutter. The second small detached portion forms a bottom end cap of the shutter. A third cut is made straight across the top cut edge of the remaining shutter, removing exactly one-half of the predetermined excess length from the top portion. The remaining one-half of the predetermined unwanted excess length is removed by a fourth cut straight across the bottom cut edge of the shutter. The top end cap is replaced on the third cut edge and fixedly secured to the shutter. The bottom end cap is replaced on the fourth cut edge and fixedly secured to the shutter. The top and bottom end caps are fixedly secured by a heat stake process or a spot weld process. The cut seams formed between the top and bottom end caps and the cut edges are concealed by applying a heat plate stamp having a wood grain pattern that reintroduces the effect into the deformed areas created by the cuts.

In an alternate embodiment where the shutter panel has two center panels, a first excess part or portion is removed from a lower part of the upper center panel near the center rail of the shutter. A second excess part or portion is removed from an upper part of the lower center panel near the center rail of the shutter. Under either two center panel embodiments, the first and second excess lengths can either be the same lengths or can be different lengths to create different length center panels as desired.

In yet another preferred embodiment, the molded shutter includes a single center panel section surrounded by an outer frame. The measurement of unwanted, excess length of the shutter is determined. A cut is made straight across one end of the shutter at the top edge of the raised center panel section, completely detaching a small portion from the remaining shutter. The small detached portion forms the end cap of the shutter. A second cut is made across the cut end of the remaining shutter, removing the predetermined excess length. The end cap is replaced on the cut edge and fixedly secured to the shutter. In the preferred embodiment the end cap is heat staked or spot welded to the shutter. The cut seam formed between the end cap and the cut edge is covered using a heat plate stamp that reintroduces the wood grain effect back into the seamline.

The method of customizing a shutter panel of the present invention is advantageous over other customizable shutter panels in that the present invention re-uses the end cap removed from the original plastic molded shutter panel, eliminating the possibility of a slightly distorted pigmentation may be present in the use of different molded plastic pieces. Furthermore, the present invention also eliminates the waste and expense of injection molding shutter panels in a significant number of varying lengths. This feature may be advantageous when manufacturing shutter panels of uncommon length.

Additional advantages and features of the present invention will become apparent from the following description, taken in conjunction with the accompanying drawings. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
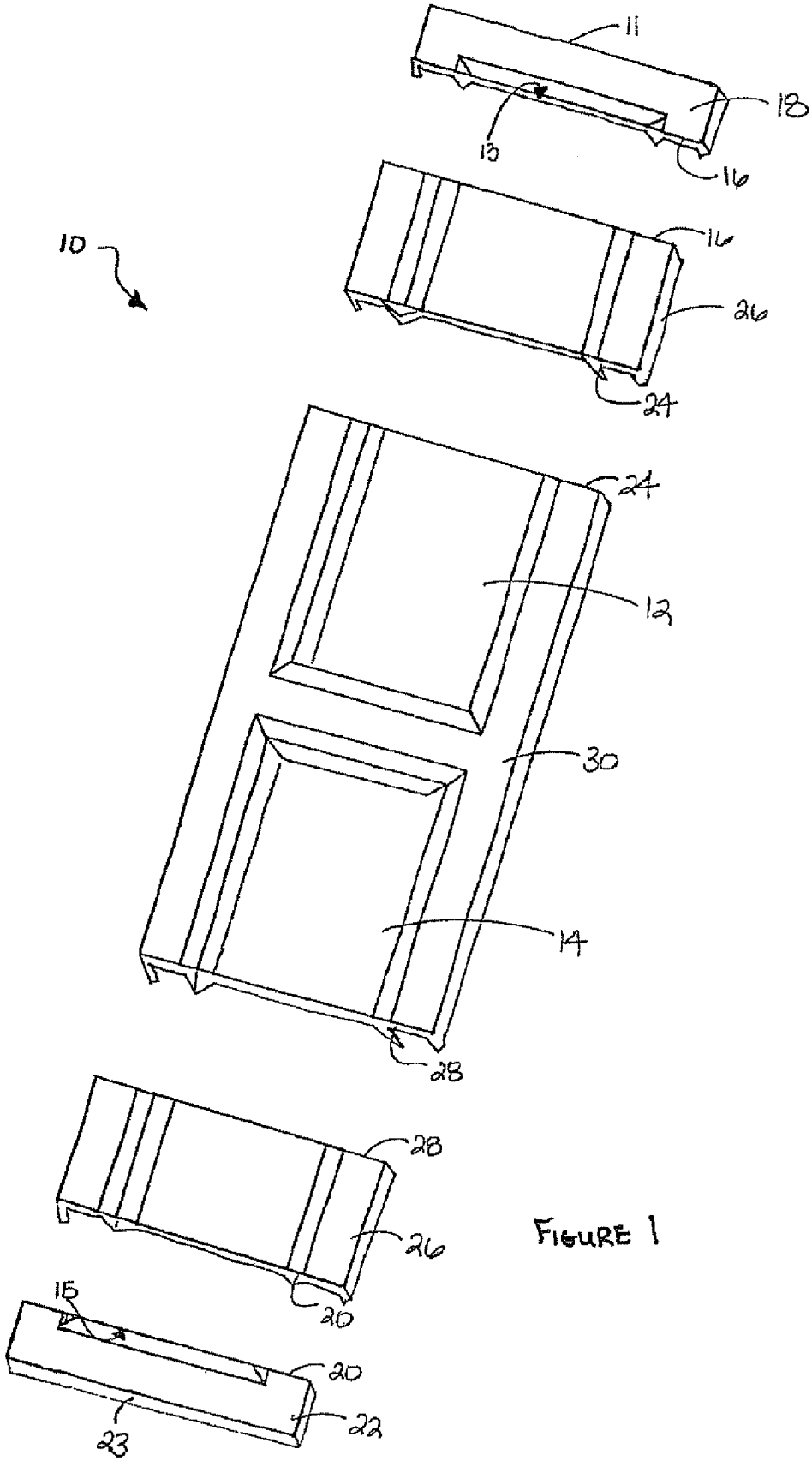
FIG. 1 is an exploded perspective view of a shutter panel having an adjustable length according to the preferred embodiment.
Figure 2:
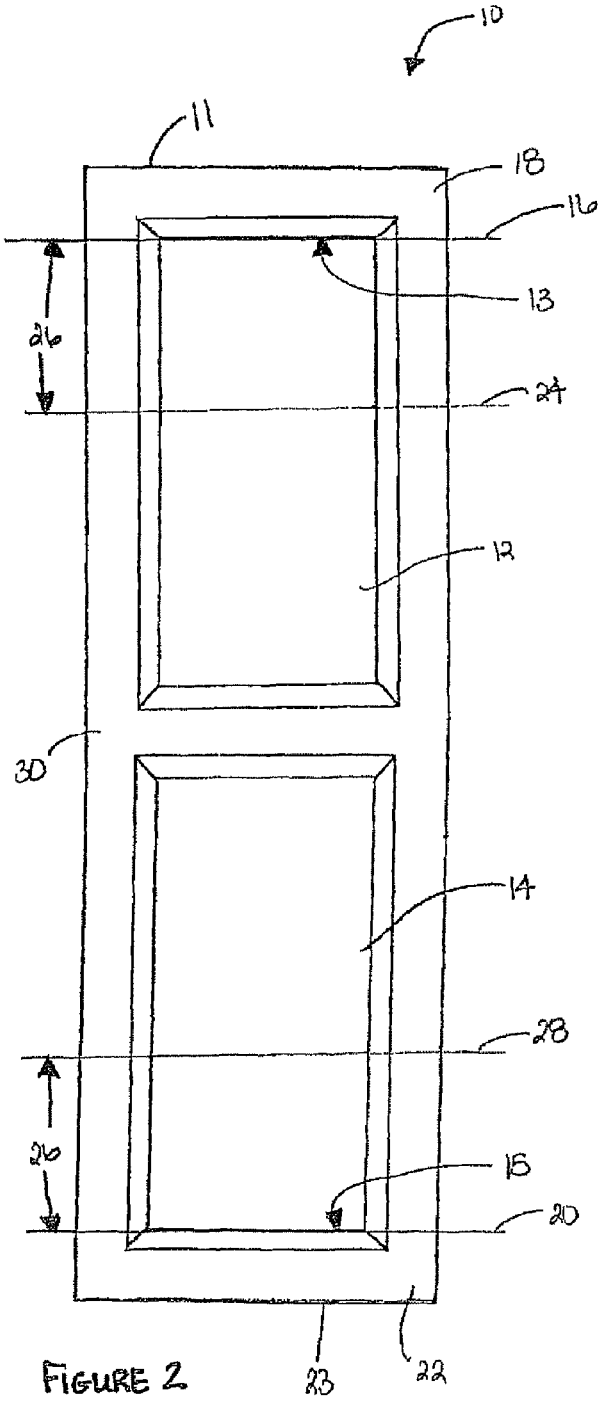
FIG. 2 is a front view of a double center panel patterned shutter having an adjustable length as shown in FIG. 1.
Figure 3:
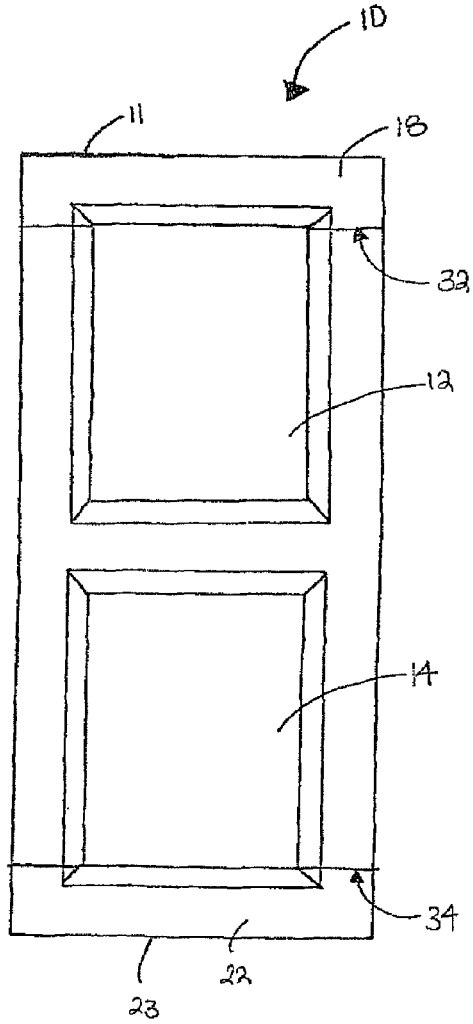
FIG. 3 is a front view of an adjusted double center panel shutter as shown in FIG. 2.

Referring to the drawings, a customizable enclosure panel, for example a shutter, 10 having two symmetrical center panels 12, 14 is shown in FIGS. 1-3. The shutter 10 is to be manufactured as a single-piece shutter formed of a pre-molded plastic of a standard length. The shutter 10 can also be chosen from a limited selection of manufactured one-piece pre-molded shutters of common lengths. The shutter panel 10 chosen from the selection is the common shutter that is closest in length to the desired length, but is not shorter than the desired length. It is understood that enclosure panel 10 can be a shutter or other enclosure panel, for example a door and other closure panels known by those skilled in the art.

The unwanted excess length of shutter material is determined. The excess length of shutter material is calculated by subtracting the desired custom shutter length from the actual or standard shutter length. A first cut edge 16 is formed straight across the shutter 10 along the upper horizontal center panel edge 13 of the top center panel 12. A first portion, for example a top end cap, 18 comprising the top 11 of the shutter 10 to the upper horizontal edge 13 of the top center panel 12, is detached from the top 11 of the shutter 10. A second cut is made on the opposing, bottom end 23 of the shutter 10. The second cut edge 20 is formed straight across the shutter 10 along the lower horizontal edge 15 of the bottom center panel 14. A second portion, for example a bottom end cap, 22 comprising the bottom 23 of the shutter 10 to the lower horizontal edge 15 of the bottom center panel 14, is detached from the bottom 23 of the shutter 10 by the second cut.

A third cut edge 24 is created straight across the remaining portion of shutter 30. The third cut edge 24 is made from a distance from the first cut edge 16. The distance from the first cut edge 16 is exactly one-half of the predetermined excess length 26. When the third cut is made, one-half of the predetermined excess shutter material 26 is removed and discarded.

A fourth cut edge 28 is made straight across the remaining shutter 30 a distance from the second cut edge 20. The distance from the second cut edge 20 to the fourth cut edge 28 is exactly one-half of the predetermined excess shutter length 26. The fourth cut removes the remaining predetermined excess length, which is discarded.

The cut edge on the top end cap 18 is aligned along the third cut edge 24 of the remaining shutter and fixedly secured in position by a heat stake or spot welding. The cut edge of the bottom end cap 22 is aligned along the fourth cut edge 28 of the remaining shutter and is also fixedly secured by a heat stake or spot welding. A heat stamp having a wood grain pattern is applied to the top seam 32, formed between the top end cap 18 and the third cut edge 24, and the bottom seam 34, formed between the bottom end cap 22 and the fourth cut edge 28. This step restores the wood grain pattern effect in the areas marred by the cuts made in the shutter 10.

Figure 6:
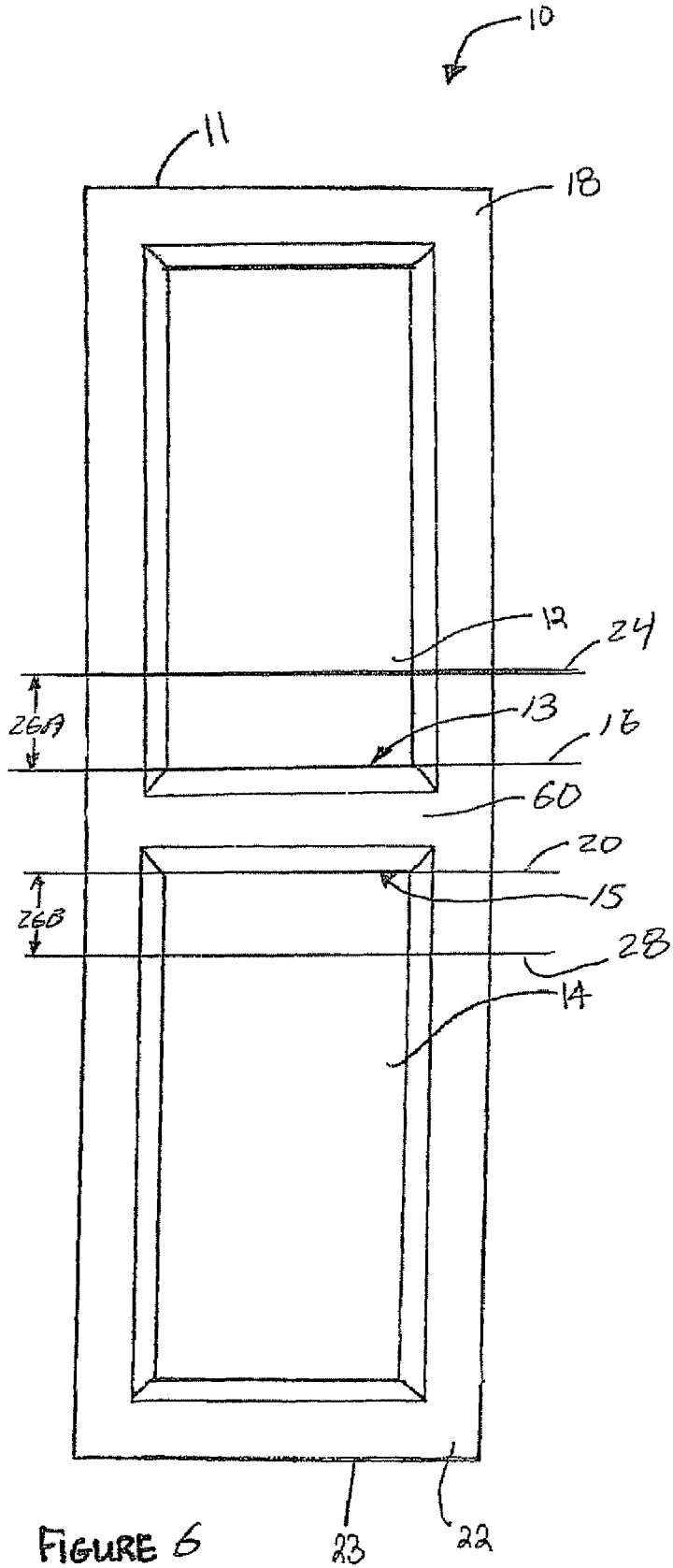
FIG. 6 is a front view of an alternate embodiment of FIG. 2.

Referring to FIG. 6 an alternate embodiment of a two center panel enclosure panel or shutter is illustrated. In this example, first cut edge 16 is cut straight across the shutter 10 along a bottom horizontal center panel edge 13 of the top center panel 12 near a center rail 60. A first portion 18 of the shutter above the first cut edge is detached from the remaining portion. A second cut is made along second cut edge 20 across the shutter 10 along an upper horizontal edge 15 of the bottom center panel 14 near center rail 60. A second portion 22 of the shutter below the second cut edge is detached from the remaining portion. A third cut edge 24 is created across the first portion 18 and a first excess length part or portion **26*a* is removed and discarded. A fourth cut edge 28 is made across the second portion 22 and a second excess length part or portion 26*b* is removed and discarded. The first portion 18 and the second portion 22 are reattached to the remaining portion including center rail 60** as described herein.

Figure 4:
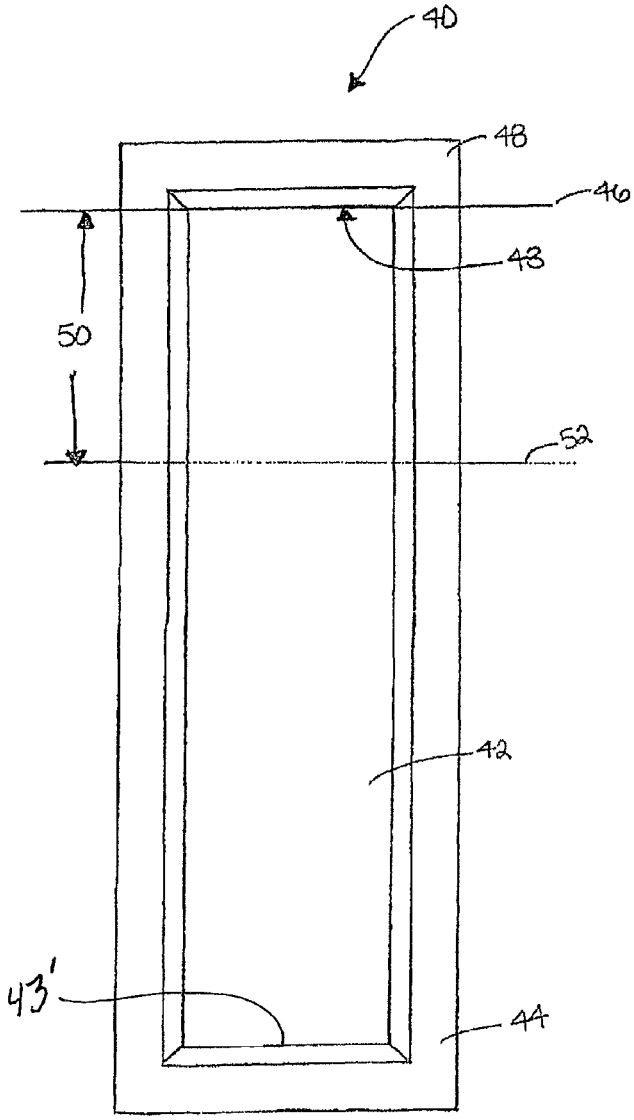
FIG. 4 is a front view of a single center panel shutter having an adjustable length according to the preferred embodiment.
Figure 5:
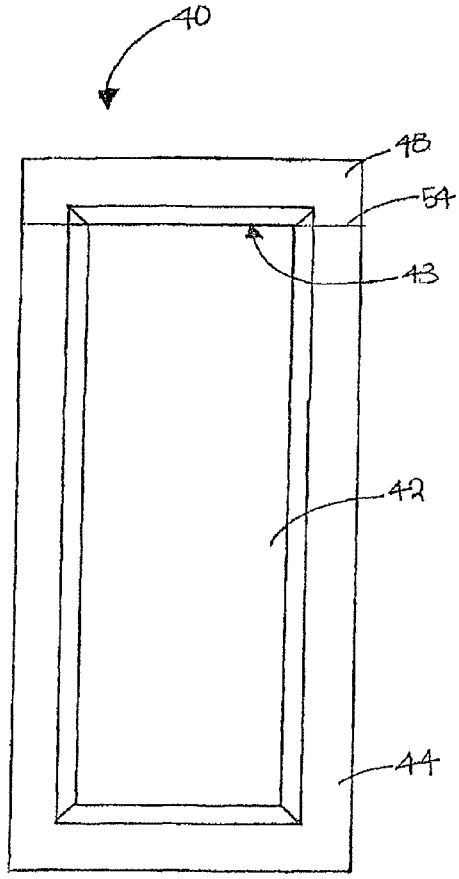
FIG. 5 is a front view of an adjusted single center panel shutter as shown in FIG. 4.

Referring to FIGS. 4 and 5, a second embodiment of a shutter 40 having an adjustable length is configured with a single center panel 42 and an outer frame 44. The excess shutter length 50 is determined A first cut edge 46 is made straight across the shutter 40 along the top edge 43 of the center panel 42 opposite the bottom edge 43' of the center panel 42. The material removed by the first cut forms a first portion, for example an end cap, 48 that is reused in the remaining shutter. A second cut edge 52 is made straight across the shutter 40, a distance from the first cut edge 46. The distance from the first cut edge 46 is equal to the predetermined excess shutter length 50. The predetermined excess shutter material 50 is completely removed and discarded. The end cap 48 is aligned to the remaining shutter along the second cut edge 52. The end cap 48 is fixedly secured to the shutter 40 by a heat stake or spot welding. A seam 54 formed between the end cap 48 and the second cut edge 52 is concealed by a heat stamp having a wood grain pattern, which reestablishes the wood grain effect into the distorted seam 54 area of the shutter 40.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method of manufacturing a custom length closure panel from a standard length closure panel having an excess length comprising the steps of:

separating a first portion from a remaining portion of the standard closure panel having a frame portion circumscribing a first center panel, the separating occurring between the first center panel and the frame portion, wherein the first center panel has an upper first center panel edge and a lower first center panel edge, and wherein the separating comprises cutting through the standard closure panel along a first cut edge positioned along the upper first center panel edge;

separating and removing an excess length from the remaining portion of the standard length closure panel to form a reduced first center panel; and attaching the first portion to the standard closure panel remaining portion creating a seam between the frame and the reduced first center panel to form the custom length closure panel.

2. The method of claim 1, wherein the standard length closure panel is a standard length shutter, the method further comprising the step of: concealing the seam to approximately match a visual exterior surface appearance of the standard length shutter.

3. The method of claim 2 wherein separating and removing the excess length further comprises separating a second portion from the remaining portion along a second cut edge of a second center panel and following the separation of the excess length attaching the second portion to the remaining portion.

4. The method of claim 3 wherein separating the excess length further comprises cutting a first excess length part along a third cut edge from the first portion first center panel and the second excess length part along a fourth cut edge from the second portion second center panel.

5. The method of claim 2 wherein concealing the seam further comprises deforming the seam with a grain pattern.

6. The method of claim 2 further comprising the steps of:

selecting a standard length shutter that is greater in length than the custom length shutter;

determining the excess length of the standard shutter from the custom length shutter, wherein the steps of selecting and determining are prior to the step of separating, wherein the step of separating comprises cutting through the standard shutter perpendicular to the length of the shutter along a first center panel edge forming a first portion separated from a remaining portion of the standard shutter, and the step of separating and removing the excess length comprises cutting through the remaining portion perpendicular to the length and discarding the excess length; and subsequent to the step of separating and removing, aligning the first portion with the remaining portion.

7. The method of claim 1 wherein the standard closure panel further has a second center panel, the frame portion comprising a center rail between the first center panel and the second center panel, wherein the step of separating and removing the excess length further comprises separating a second portion opposite the first portion from the remaining portion of the standard closure panel between the center rail and the second closure panel.

8. The method of claim 7 further comprising removing a first part of the excess length along the first center panel above the center rail and a second part of the excess length along the second center panel below the center rail.

9. The method of claim 8 wherein the first part of the excess length and the second part of the excess length are approximately equal in length.

10. The method of claim 1, wherein the standard closure panel further has a second center panel, the frame portion circumscribing both the first center panel and the second center panel, the method further comprising separating a second portion from the remaining portion of the standard closure panel opposite the first portion between the second center panel and the frame portion, and following separation of an additional excess length to form a reduced second center panel, attaching the second portion to the remaining portion.

11. The method of claim 10 wherein the second center panel has an upper second center panel edge and a lower second center panel edge, and separating the second portion further comprises the step of cutting through the standard closure panel along a second cut edge positioned along the lower second center panel edge.

12. The method of claim 1 wherein the first portion is a top end cap of the standard closure panel and the excess length is along a height of the closure panel.

13. The method of claim 1 further comprising concealing the seam between the standard closure panel remaining portion and the remaining portion.

14. The method of claim 1 wherein the standard length closure panel is a shutter.

* * * * *